US006303075B1

(12) United States Patent
Shobu et al.

(10) Patent No.: US 6,303,075 B1
(45) Date of Patent: Oct. 16, 2001

(54) HIGH TEMPERATURE OXIDATION RESISTANT ALLOY MATERIALS AND METHOD OF PRODUCING THE SAME

(75) Inventors: Kazuhisa Shobu; Hisatoshi Hirai; Tatsuo Tabaru; Hidetoshi Ueno; Akira Kitahara, all of Tosu (JP)

(73) Assignee: Agency of Industrial Science and Technology, Tokyo (JP)

( * ) Notice: Subject to any disclaimer, the term of this patent is extended or adjusted under 35 U.S.C. 154(b) by 0 days.

(21) Appl. No.: 09/534,625

(22) Filed: Mar. 27, 2000

(30) Foreign Application Priority Data

Nov. 12, 1999 (JP) ..... 11-322391

(51) Int. Cl.[7] ..... B22F 3/10; B22F 7/02

(52) U.S. Cl. ..... 419/10; 419/19; 419/26; 419/29

(58) Field of Search ..... 419/10, 19, 26, 419/29

(56) References Cited

U.S. PATENT DOCUMENTS 3,765,953 * 10/1973 Chevillon et al. .
4,836,849 * 6/1989 Svedberg et al. ..... 75/245
4,904,546 * 2/1990 Jackson ..... 428/661
4,983,358 * 1/1991 Hebsur et al. ..... 420/425
5,180,446 * 1/1993 Tsukuta et al. ..... 148/422
5,640,767 * 6/1997 Jackson et al. ..... 29/889.721

* cited by examiner

*Primary Examiner*—Ngoclan Mai
(74) *Attorney, Agent, or Firm*—Oblon, Spivak, McClelland, Maier & Neustadt, P.C.

(57) ABSTRACT

A high temperature Nb-base alloy material which contains a ductile Nb-base metal phase to secure the toughness of the alloy at a normal temperature, and yet it can provide a dense oxide film in a high temperature oxidative atmosphere, thereby it can maintain excellent oxidation resistance even when the coating is broken, i.e. it has self repairing function, is provided.

The high temperature oxidation resistant alloy material is constructed by adding a trace amount of metal Mg which is necessary to form a dense oxide film comprising MgO as a main component on the surface in an elevated temperature oxidative atmosphere, to a composite phase alloy comprising not less than 10% by volume of a Nb-base solid solution metal phase represented by atomic ratio as Nb—(15–40%)Ti—(5–20%)Al and the remainder of one or more kinds of intermetallic compound phases or ceramic phases having high oxidation resistance.

2 Claims, 1 Drawing Sheet

HIGH TEMPERATURE OXIDATION RESISTANT ALLOY MATERIALS AND METHOD OF PRODUCING THE SAME

FIELD OF THE INVENTION

The present invention relates to a high temperature alloy material having excellent oxidation resistance and a method of producing the same.

In particular, the present invention relates to a high temperature alloy material to which excellent oxidation resistance is imparted by allowing a Nb—Ti—Al type alloy material to incorporate Mg, and a method of producing the same.

DESCRIPTION OF THE RELATED ART

In the past, Ni-base superalloys have been generally employed as materials for a gas turbine requiring particularly high temperature strength and excellent oxidation resistance. As the gas turbine provides higher energy efficiency at a higher temperature, various efforts have been made to improve the heat resistance of the Ni-base superalloys, and recently, a unidirectionally solidified material or a single crystal superalloy came to a practical stage. It is, however, well known that the improvement in the heat resistance of the Ni-base superalloy has been already approaching its limit as the melting point of Ni is not so high. Therefore, intermetallic compounds and ceramics having inherently high heat resistance, or metals having high melting points such as Nb have been studied as potential materials which may surmount the limit of the Ni-base superalloys.

The former two materials are still far away from the commercial stage since they are inherently brittle and the resulting low reliability is not yet overcome. In recent years, fiber-reinforced composites have been examined, however they are still under investigation and there are serious difficulties not only in their physical properties, but also in their cost effectiveness, and productivity etc.

On the other hand, high melting point metals such as Nb, W, Mo, and Ta have very high melting points in comparison with Ni. In particular, Nb is a high melting point metal with a melting point of not less than 2400° C., showing ductility at a room temperature, it is free from intrinsic problems related to mechanical reliability, different from intermetallic compounds or ceramics. Though they have some problems related to the mechanical characteristics such as strength at an elevated temperature, they can be handled by the conventionally known techniques employed in development of alloys, and it is likely that they are overcome. A serious problem is that Nb has fatally inferior resistance to oxidation at an elevated temperature. When this problem is solved, Nb has high possibility as a practical material which is more advantageous than the Ni-base alloy, however, it is still under investigation.

To be used for a gas turbine, it should have sufficiently high oxidation resistance at a temperature not less than 1000° C. As the Nb-base alloy has inherently poor oxidation resistance, it is very difficult to improve the oxidation resistance of the alloy itself to a practical level without degrading the toughness of the material at a normal temperature. Therefore, in actuality, it is contemplated that such material is coated with another material having high oxidation resistance such as $MoSi_2$ to provide oxidation resistance, and in effect, it is known that such coating can provide excellent oxidation resistance.

But the coating materials must be selected from intermetallic compounds and ceramics in order to give sufficient oxidation resistance, therefore the coated film is not free from the possibility of cracking, peeling, or fatigue failure and the like, and it is difficult to provide a practical and highly reliable product by itself.

That means, oxidation resistance must be imparted to a Nb-base alloy mainly by means of coating, however it is required to have a measure to assure enough oxidation resistance even when the coating is broken. Therefore, it is necessary to impart self-repair properties to the oxidation resistant coating film. Such self-repair properties are brought by limited oxidation of the Nb-base alloy material, therefore the Nb-base material, as the base material, needs to provide a dense oxide film on the surface in a high temperature oxidative atmosphere and the resulting oxide film shall have a sufficiently low oxygen diffusion rate.

In the past, various investigations have been made to improve the oxidation resistance of a Nb-base alloy (see for example "The Oxidation Behavior and Protection of Niobium" Journal of Metals, August, p.17, 1990). Usually, a metal oxide is generated on the surface of the metal when it is oxidized at an elevated temperature, however when the oxide is produced in the form of a dense film, the oxidation rate is controlled by the diffusion of the metal element or oxygen permeating through the oxide film. Accordingly, when an oxide film having sufficiently low such diffusion rate is formed, the metal shows low oxidation rate and good oxidation resistance. Oxidation of metal Nb results in an oxide thereof, $Nb_2O_5$, which has relatively high oxygen diffusion rate at an elevated temperature, therefore, it shows high oxidation rate at a temperature over 500° C. and it cannot be used as a high temperature material as it is.

Therefore, it has been examined that an element which is more susceptible to oxidation than Nb is added to form an alloy, and to generate a dense oxide film of the added element. In particular, Al and Si can provide excellent oxidation resistant films, since their oxides $Al_2O_3$ and $SiO_2$ have very low oxygen diffusion rates even at an elevated temperature. In order to produce $Al_2O_3$ and $SiO_2$ in an oxidative atmosphere, Al and Si must be contained in the alloy in a sufficiently high concentration, however, Al or Si cannot be added to Nb in a very large amount. That is when they are added in a large amount, they form intermetallic compounds with Nb, and the intermetallic compounds are brittle as described before, therefore they decrease the toughness to a great extent particularly at a low temperature, though they show good oxidation resistance.

That means, a basic condition for a practical alloy material which has reliable mechanical characteristics, is that it shall contain a ductile Nb-base metal phase (body-centered cubic system phase) at least in an amount of not less than 10% by volume, preferably not less than 40% by volume. However, in Nb metal phase, Al, for example, can only be incorporated in an amount of up to 10% (by atomic ratio) at 1200° C., and this amount of Al is absolutely insufficient for producing a dense $Al_2O_3$ film in a high temperature oxidative atmosphere. Therefore, under the basic condition that the Nb-base metal phase shall be contained in the structure, a dense oxide film such as $Al_2O_3$ and $SiO_2$ can not been generated by high temperature oxidation, or they have not been generated at least until now, and it seems very unlikely that it can be done in future as well.

Based on these basic matters, various examinations and improvements have been made, and currently a Nb-base alloy having similar degree of oxidation resistance as that of Ni-base superalloy has been made, which is based on Nb—Ti—Al ternary alloy. (For example, see "The Development of Nb-Based Advanced Intermetallic Alloys for Structural Applications", Journal of Metals, January, p.33–38, 1996). The relatively high oxidation resistance of these alloys are mainly attributed to the generation of an oxide film containing $TiO_2$ as its main component, however, since the oxygen diffusion rate through $TiO_2$ is rather high at a high temperature, the resulting oxidation resistance is insufficient.

SUMMARY OF THE INVENTION

The present invention aims to further improve the oxidation resistance of such Nb-base alloys. More specifically, the present invention is to provide a high temperature Nb-base alloy material which contains a ductile Nb-base metal phase to secure the toughness of the alloy at a normal temperature, and yet it can provide a dense oxide film in a high temperature oxidative atmosphere, thereby it can maintain excellent oxidation resistance even when the coating is broken, i.e. it has a self repairing function and a method of producing the same.

Another object of the present invention is to provide a high temperature oxidation resistant alloy material which has such high oxidation resistance that allows its use in air at a temperature over 1000° C., has high strength and high toughness at both normal and elevated temperatures, that allows its use for a component that requires high heat resistance, high mechanical strength and high reliability such as a rotor of a gas turbine and the like, and a method of producing such alloy materials.

In order to achieve the above-mentioned objects, the present inventors have extensively studied on oxidation of Nb-base alloys and found that the objects can be achieved by adding Mg to the Nb-base alloy and completed the present invention based on this finding.

Accordingly, a high temperature oxidation resistant alloy material of the present invention comprises a composite phase alloy comprising not less than 10% by volume of a Nb-base solid solution metal phase represented by atomic ratio as Nb—(15–40%)Ti—(5–20%)Al and the remainder of one or more kinds of intermetallic compound phases or ceramic phases having high oxidation resistance, and characterized by addition of a trace amount of metal Mg that is necessary for a dense oxide film comprising MgO as a main component to be formed on the surface in a high temperature oxidative atmosphere.

A method of producing a high temperature oxidation resistant alloy material of the present invention comprises adding a powder of an intermetallic compound containing Mg to a raw material powder of a composite phase alloy comprising not less than 10% by volume of a Nb-base solid solution metal phase represented by atomic ratio as Nb—(15–40%)Ti—(5–20%)Al and the remainder of one or more kinds of intermetallic compound phases or ceramic phases having high oxidation resistance, sintering them by powdered metal technique, or adding MgO powder to the raw material powder of the composite phase alloy and sintering them at a temperature not less than 1600° C. by powdered metal technique, and thereby partly reducing MgO to generate metal Mg.

The high temperature oxidation resistant alloy material obtained according to the present invention as described above, can provide a dense oxide film comprising MgO as a main component on its surface in an oxidative atmosphere at a temperature over 1000° C., thereby showing excellent oxidation resistance, and when used together with an oxidation resistant coating, the reliability of the coating against oxidation can be greatly improved. As it contains such a metal phase in its structure that shows ductility at a normal temperature, the mechanical characteristics are highly reliable as well. Therefore, it is not only useful for a moving vane of a gas turbine etc, the uses for which only Ni-base superalloys can be employed so far, but also for the uses at high temperatures for which even such superalloys cannot be employed so far.

DESCRIPTION OF EXAMPLES

Figure 1:
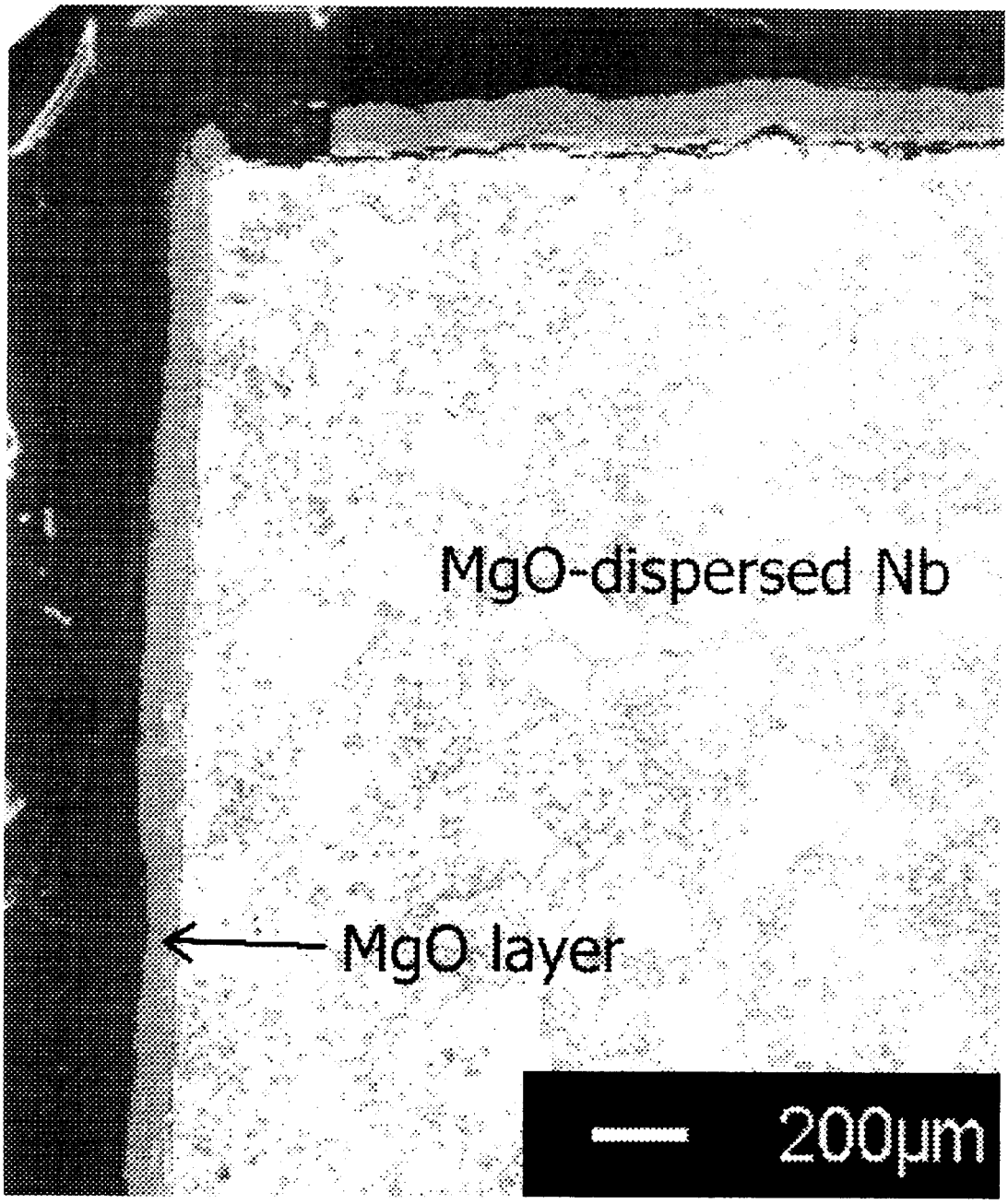
FIG. 1 is a photomicrograph of a section of a sample of Example 2 after having subjected to oxidation test, which is given as a substitute for a drawing.

The high temperature oxidation resistant alloy materials according to the present invention and a method of producing the same will be described in details.

An alloy which is the base for the high temperature oxidation resistant alloy material according to the present invention contains Nb-base solid solution metal phase in the structure in an amount of not less than 10% by volume. The Nb-base solid solution metal phase is necessary to assure the toughness of the alloy at a sufficiently low temperature as described before, and which is a body-centered cubic system containing 5–20% (by atomic ratio) of Al, 15–40% of Ti and the rest essentially consisting of Nb.

Incorporation of Cr in an amount of up to 5% (by atomic ratio) and that of Si in an amount of up to 1% can improve oxidation resistance to some extent, however, it is not essentially required for the MgO oxide film formation according to the present invention. In order to improve the high temperature mechanical characteristics, it is better to add at least one metal selected from Ta, W and Mo in an amount of up to 20% (by atomic ratio), however, this is not essentially required as well for the MgO oxide film formation. The above-mentioned Al and Ti are essential components required for formation of a MgO oxide film as shown in the following Examples. When the amount of Ti added is large, the high temperature mechanical properties are degraded, therefore it is better to control the amount of Ti added to be not more than 40%.

On the other hand, the remainder of the Nb-base metal phase constituting the structure of the alloy material can be one or more kinds of intermetallic compound phases or ceramic phases having sufficiently high melting point and sufficient oxidation resistance by itself, such as oxides including MgO and intermetallic compounds including $Nb_5Si_3$ and the like. Of course they must be those which can stably co-exist with the above-mentioned Nb-base metal phase.

The alloy material according to the present invention can be obtained by adding such a trace amount of Mg that is necessary to form a dense oxide film comprising MgO as its main component on the surface in a high temperature oxidative atmosphere, to a composite phase alloy as described above. The production method will be described as follows.

In principle, an alloy material according to the present invention can be produced by conventional powder metallurgical technique or melt process and the like. Since Nb has a high melting point, powder metallurgical technique is practical. In such a case, raw material powder mixture which is adjusted to produce a desired structure and composition shall be prepared in the first place. This can be simply obtained by sufficiently uniformly mixing raw material powders of each element or compound, wherein it is better to divide each raw material powder as fine as possible in order to give a homogeneous composition following the sintering. The mixed raw material powder produced in such a way is then subjected to conventional sintering method such as hot press method, HIP method or ordinary sintering method.

More specifically, the alloy material according to the present invention contains Mg in its structure such that it generates MgO in an oxidative atmosphere, and methods to incorporate the Mg include a method in which Mg powder or a powder of an intermetallic compound containing Mg such as $Mg_2Si$, or MgO powder is mixed with the raw material powder mixture from the beginning. In the case of MgO powder, as the Nb-base solid solution metal phase contains Ti and Al, it is partly reduced to result in metal Mg. Therefore, when MgO is employed, a sintering temperature of not less than 1600° C. is preferable to promote the reduction. On the contrary, in any method, an elevated temperature over 1900° C. is not desirable due to high vapor pressure of Mg itself.

The amount of the Mg containing additive added depends on the necessary film thickness of the produced MgO film to provide sufficient oxidation resistance, therefore it depends on the size and the shape of the product, as well as oxidation conditions. Normally the amount of Mg calculated based on the total alloy material (the amount of Mg derived from MgO and the like) is very little around 0.05–1%, but the optimal amount of Mg added shall be decided according to the required oxidation resistance and mechanical properties and the like. We deem that Mg is probably slightly dissolved in Nb—Ti—Al phase or unevenly distributed at the grain boundary, however it has not yet been verified.

As another method of incorporating Mg, a diffusion penetration method can be naturally used. In this case, an alloy material free from Mg is produced in the first place, then Mg is diffused and penetrated from the surface layer to provide an alloy material according to the present invention. For example, it is possible in principle to obtain an alloy according to the present invention as follows; the alloy material free from Mg which is produced according to the above-mentioned powder metallurgical technique is buried in MgO powder or a mixture of MgO and $Mg_2Si$ powder, and subjected to heat treatment at an elevated temperature (powder bed method) so that Mg is diffused and contained in the surface layer of the product in Mg atmosphere.

The alloy material according to the present invention provides a dense oxide film comprising MgO as its main component on the surface in a high temperature oxidative atmosphere, it shows excellent oxidation resistance under certain high temperature conditions. However, the thermal expansion rate of MgO is quite larger than that of the alloy material, when the material is heated or cooled, the oxide film can be spalled off by thermal stress.

Therefore, the alloy material of the present invention shall not be employed as it is, but it shall be employed with the oxidation resistant coating, as mentioned before. In such a case, the formation of the dense MgO film by the alloy material according to the present invention works as self-repairing mechanism to repair the damage of the oxidation resistant coating.

The present invention will be explained in more detail with the following Examples, but they are not construed to limit the present invention.

As the Ni-base solid solution metal phase has the worst oxidation resistance, in the following examples those having the largest volume of the metal phase are given. The lower the volume ratio of said metal phase is, the better the oxidation resistance is, however, from the view point of the mechanical characteristics at the normal temperature, the content must be at least not less than 10%.

EXAMPLE 1

Nb metal powder of up to #200 mesh, Ti metal powder of up to #200 mesh, Al raw material powder of up to #200 mesh and $Mg_2Si$ powder of up to #40 mesh were blended to provide composition on an atomic percent basis of 38%Nb—38%Ti—18%Al—2%Si—4%Mg, and well mixed in a ball mill. Then the mixed powder was put in a graphite mold coated with BN, and hot-press sintered at 1700° C. at uniaxial pressure of 30 MPa for 30 minutes in a vacuum atmosphere. After the sintering the sample was almost completely densified and a single phase of a solid solution metal phase was identified by X-ray diffraction and electron microscopic observation.

That composition corresponds to the composition in a phase diagram which becomes nearly a single phase of a metal phase at a temperature not less than 1200° C. A rectangular sample was cut out from said sample and subjected to oxidation test in air at 1250° C. for 60 hours using a thermo-balance. The weight increase by the oxidation was parabolic and suggested that a dense film was formed and oxidation rate was determined by diffusion. The oxidized sample was covered with a dense oxide film comprising MgO as a main component. The alloy composition of the sample and formation of the oxide film are described in Example 1 in Table 1.

TABLE 1

| No. | Alloy composition (atomic ratio) | Formation of an oxide film |
|---|---|---|
| 1 | 38%Nb-38%Ti-18%-Al-2%Si-4%Mg | A dense MgO film was formed with a small oxidation rate. |
| 2 | (40%Nb-40%Ti-20%Al)-MgO | A dense MgO film was formed with a small oxidation rate. |
| 3 | 35%Nb-35%Ti-30%Al-MgO(15%) | A dense MgO film was formed with a small oxidation rate. |
| 4 | (70%Nb-20%Ti-1O%Al)-MgO | A dense MgO film was formed with a sinall oxidation rate. |
| 5 * | (40%Nb-40%Ti-18%Al)-2%Si | A porous film comprising $TiO_2$ as its main component was formed with a big oxidation rate. |
| 6 * | (50%Nb-50%Ti)-MgO | Fast oxidation. MgO film was not formed. |

TABLE 1-continued

| No. | Alloy composition (atomic ratio) | Formation of an oxide film |
|---|---|---|
| 7 * | (80%Nb-20%Al)-MgO | Fast oxidation. MgO film was not formed. |
| 8 * | 80%Nb-16%Al-2%Si-4%Mg | Fast oxidation. MgO film was not formed. |

* shows comparative example

Table 1 shows the relation between the alloy composition and the formation of the oxide film, and all the alloys were produced by powder metallurgical technique, and hot pressed at 700° C., at 30 MPa, in vacuum for 30 minutes. The oxidation test as carried out in air at 1250° C. for 10–60 hours. When MgO was added, it was added in an amount of 15% by weight (outer percentage) in Example 3, otherwise in an amount of 30% by weight (outer percentage)

EXAMPLE 2

Nb metal powder of up to #200 mesh, Ti metal powder of up to #200 mesh, and Al raw material powder of up to #200 mesh were blended to provide composition on an atomic percent basis of 40%Nb—40%Ti—20%Al, and MgO powder in an amount of 30% by weight (outer percentage) was added thereto and mixed well in a ball mill. As the MgO powder, fine powder of #325 was employed. Then the mixed powder was hot-press sintered under the same conditions as those used for Example 1 and a dense sintered product was obtained. The sintered product had a structure in which MgO phase was homogeneously dispersed in solid solution metal matrix. A rectangular sample was cut out from the sample and subjected to oxidation test in air at 1250° C. for 60 hours using a thermo-balance. The weight increase by the oxidation was parabolic like Example 1, the sample after the oxidation test was covered with a dense oxide film comprising MgO as a main component. The alloy composition of the sample and the description of the surface film after the oxidation test are given in Example 2 in Table 1. The section of the sample after the oxidation test is given in FIG. 1 which shows the formation of a dense oxide film comprising MgO as the main component.

EXAMPLE 3

Nb metal powder of up to #325 mesh, Ti metal powder of up to #325 mesh, and Al raw material powder of up to #325 mesh were blended to provide composition on an atomic percent of 35%Nb—35%Ti—30%Al, and MgO powder in an amount of 15% by weight (outer percentage) was added thereto and well mixed in a ball mill. As the MgO powder, fine powder of #325 was employed. Then the mixed powder was hot-press sintered under the same conditions as those used in Example 1 and a dense sintered product was obtained. The sintered product had a structure comprising Nb—Ti—Al solid solution metal phase, (Nb, Ti)2Al intermetallic compound phase, and MgO phase as shown in phase diagram. A rectangular sample was cut out from the sample and subjected to oxidation test in air at 1250° C. for 12 hours using a thermo-balance. The sample after the oxidation test was covered with a dense oxide film comprising MgO as a main component. The result is given in Example 3 of Table 1. As it can be expected, the sintered product was obviously brittle compared to the sample obtained in Example 2.

As can be seen from the above test results, addition of an intermetallic compound phase or an oxide phase having good oxidation resistance does not affect the oxidation and improves the high temperature mechanical characteristics, however invites brittleness at a room temperature. Therefore, the Nb-base solid solution metal phase must be contained in an amount of at least not less than 10% by volume as described above.

COMPARATIVE EXAMPLE 1

Nb metal powder of up to #200 mesh, Ti metal powder of up to #200 mesh, Al raw material powder of up to #200 mesh, and Si powder of up to #325 mesh were blended to provide composition on an atomic percent basis of 40%Nb—40%Ti—18%Al—2%Si, and well mixed in a ball mill. Then the mixed powder was hot-press sintered in the same manner as that used in Example 1 and a dense solid solution metal singe phase alloy was obtained. A rectangular sample was cut out from the sample and subjected to oxidation test in air at 1250° C. for 10 hours using a thermo-balance. The weight increase by the oxidation was linear, different from those in Examples 1 and 2. The oxidized sample was covered with a porous oxide film comprising $TiO_2$ as a main component. The alloy composition of the sample and the description of the surface film after the oxidation test are given in Example 5 of Table 1.

What is claimed is:

1. A method of producing a high temperature oxidation resistant alloy material, comprising:

adding MgO powder to a raw material powder of a composite phase alloy comprising not less than 10% by volume of a Nb-base solid solution metal phase represented by atomic ratio as Nb—(15–40%)Ti—(5–20%)Al and the remainder of one or more kinds of intermetallic compound phases or ceramic phases having high oxidation resistance; and sintering said MgO powder and said raw material powder at a temperature not less than 1600° C. by a powder metallurgical technique, thereby reducing at least a portion of said MgO powder to generate metal Mg.

2. The method according to claim 1, further comprising:

forming, on a surface of said alloy, a dense oxide film comprising MgO as a main component, wherein said forming of said dense oxide film occurs in an oxidative atmosphere at an elevated temperature.

* * * * *